US006001206A

United States Patent [19]

Zaher

[11] Patent Number: 6,001,206

[45] Date of Patent: Dec. 14, 1999

[54] METHOD AND APPARATUS FOR APPLYING A DECORATION TO AN ARTICLE USING HEAT

[75] Inventor: Maximilian Zaher, Oldenberg, Germany

[73] Assignee: Bush Industries, Inc., Jamestown, N.Y.

[21] Appl. No.: 08/946,802

[22] Filed: Oct. 8, 1997

[30] Foreign Application Priority Data

Oct. 31, 1996 [EP] European Pat. Off. ..... 96117501

[51] Int. Cl.[6] ..... B44C 1/165

[52] U.S. Cl. ..... 156/230; 156/322

[58] Field of Search ..... 156/155, 230, 156/239, 240, 322

[56] References Cited

U.S. PATENT DOCUMENTS

| | | | |
|---|---|---|---|
| 3,671,288 | 6/1972 | Rosenberg | 117/39 |
| 3,867,173 | 2/1975 | Putzer | 117/39 |
| 4,010,057 | 3/1977 | Nakanishi | 156/384 |
| 4,229,239 | 10/1980 | Arai et al. | 156/155 |
| 4,231,829 | 11/1980 | Marui et al. | 156/230 |
| 4,269,650 | 5/1981 | Arai et al. | 156/540 |
| 4,348,246 | 9/1982 | Nakanishi | 156/73.1 |
| 4,388,866 | 6/1983 | Nakanishi | 101/426 |
| 4,407,881 | 10/1983 | Shima et al. | 428/156 |
| 4,436,571 | 3/1984 | Nakanishi | 156/384 |
| 5,695,587 | 12/1997 | Dumoux | 156/230 |

FOREIGN PATENT DOCUMENTS

| | | |
|---|---|---|
| 0726170 | 8/1996 | European Pat. Off. . |
| 1125458 | 8/1968 | United Kingdom . |

OTHER PUBLICATIONS

European Search Report, EP 96 11 7501 dated Apr. 1, 1997.

*Primary Examiner*—Michael W. Ball
*Assistant Examiner*—Gladys Piazza
*Attorney, Agent, or Firm*—Webb Ziesenheim Logsdon Orkin & Hanson, P.C.

[57] ABSTRACT

A method and apparatus for applying a pre-formed decoration to an article provides that the article is immersed into a liquid on which the decoration is floating. Prior to transferring the decoration to the article, the decoration is heated and hot water vapor may be used.

6 Claims, 3 Drawing Sheets

METHOD AND APPARATUS FOR APPLYING A DECORATION TO AN ARTICLE USING HEAT

BACKGROUND OF THE INVENTION

1. Field of the Invention

The invention relates to a method and apparatus for applying a pre-formed decoration to an article by using hydrostatic pressure and by heating the decoration before it is transferred to the article.

2. Background of the Prior Art

U.S. Pat. No. 4,010,057 , corresponding to German Patent No. DE-A- 25 34 640, describes a method and corresponding apparatus for applying a decoration to an article using hydrostatic pressure. This patent is hereby incorporated by reference. However, this patent neither teaches nor suggests heating the decoration before such a decoration is applied to the article.

U.S. Pat. No. 3,867,173 describes a method of decorating objects with wax in which heated wax is dripped upon a liquid surface to form a film and the article to be decorated is then dipped into the liquid thereby receiving the wax film. However, the wax dripped upon the liquid surface is unrestrained and free to assume any shape on the surface of the liquid. For that reason, the appearance of the wax film on the article will be entirely random and unsuitable for situations requiring repetitive applications of a pre-formed decoration.

U.S. Pat. No. 4,348,246 and U.S. Pat. No. 4,388,866 describe transfer printing techniques in which the film with the decoration to be transferred is not placed upon a layer of water but instead is placed upon a layer of granules or a deformable layer of pins.

U.S. Pat. No. 4,436,571 describes a transfer printing technique in which the article to receive a decoration is immersed in a specific way into a flowing liquid with the decoration floating thereupon. The article is presented to the decoration in a continuous movement in the general direction of the liquid flow along a downward path oblique to the surface of the liquid and then along an upward path oblique to the surface of the liquid to provide contact between the decoration and the article.

U.S. Pat. No. 4,407,881, corresponding to DE-A- 32 19 992, describes a transfer printing technique in which the decoration is supported on a layer of a special film made of a hydrophilic, deformable layer which can swell by absorption of water, and a further layer which is placed over the hydrophilic layer and is varyingly permeable to water so that the hydrophilic layer expands to a greater or lesser extent.

U.S. Pat. No. 4,229,239 describes another transfer printing technique in which the decoration is prepared before the transfer by a solvent in order that it detaches itself more easily from the supporting film when transferred onto the article. This activation of the decoration (printing pattern) takes place directly before transferring the film with the decoration to the surface of the water. The film supporting the decoration is water soluble so that, upon contact with the water, the film dissolves and the decoration is then floating on the surface of the water alone (without the film). The decoration is then transferred to the article to be decorated by subsequent immersion of the article.

U.S. Pat. No. 4,231,829 describes a transfer printing technique in which boric acid or a salt thereof is added to a PVA film supporting the decoration on the liquid or to the water on which the decoration floats in order to promote the transfer process.

U.S. Pat. No. 4,269,650 also describes a transfer printing technique utilizing the addition of a solvent in order to make the detachment of the decoration from the supporting film easier.

The solvents provided in the prior art discussed above for activation of the decoration are, for example, pentanes, hexanes, heptanes, octanes, gasoline (petrol) or else aromatic hydrocarbons, such as benzene, toluene, cyclohexane, etc. To promote the activation by means of such solvents, the addition of synthetic resins, such as halogenated vinylchlorides and the like, is also proposed in the cited prior art.

Use of solvents for activation of the decoration is laborious and requires special measures for environmental protection.

SUMMARY OF THE INVENTION

The apparatus of the present invention is directed to applying a pre-formed decoration to an article utilizing the hydrostatic pressure of a liquid medium and comprises a device for heating the decoration to a temperature above ambient conditions, a container filled with liquid wherein the heated decoration may float on the surface of the liquid and wherein the container is filled to a depth sufficient for the article to be submerged against the decoration thereby promoting transfer of the decoration to the surface of the article, and means for urging the article against the decoration.

The method of the present invention is directed to applying a pre-formed decoration to an article utilizing the hydrostatic pressure of a liquid medium and comprises the steps of heating the decoration to a temperature above ambient conditions; floating the heated decoration on the surface of a liquid; positioning the article above the floating decoration; and immersing the positioned article into the liquid and against the floating decoration thereby permitting the decoration to transfer to the article.

A preferred configuration of the invention provides that after the decoration is transferred to the article, the decoration is again treated with hot vapor. This removes or considerably promotes the removal of undesired residues, such as film residues, on the decoration.

BRIEF DESCRIPTION OF THE DRAWINGS

An exemplary embodiment of the invention is described in more detail below with reference to the drawings, in which.

DESCRIPTION OF THE PREFERRED EMBODIMENTS

Figure 1:
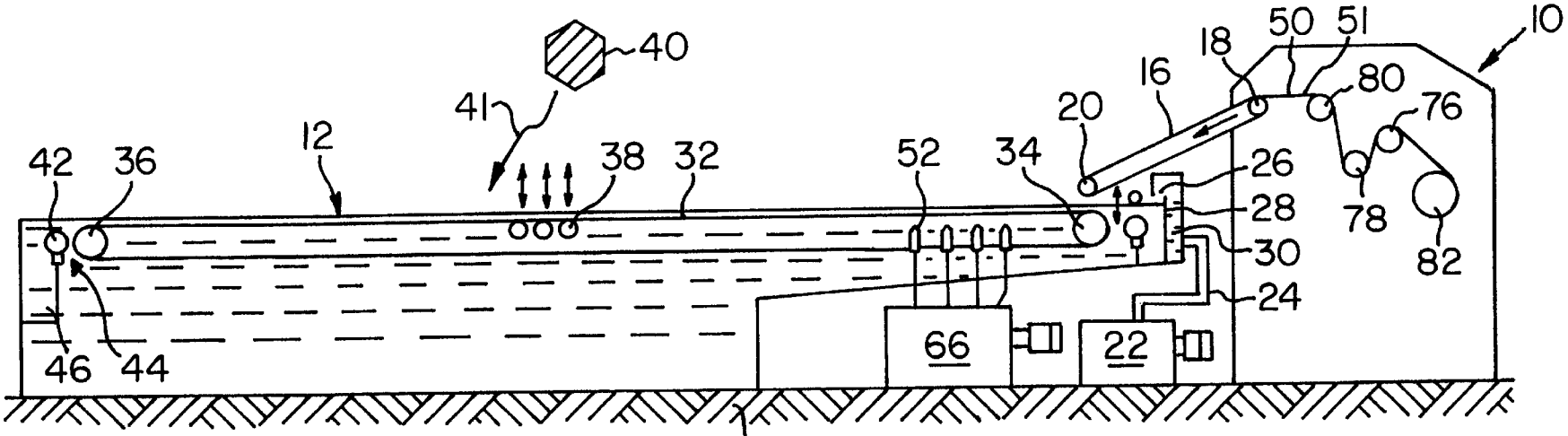
FIG. 1 shows a schematic view from the side of an apparatus for applying a decoration to an article in accordance with the subject invention.

FIG. 1 shows a transfer printing apparatus. On the right a housing 10 in which a supporting film 50 having a series of pre-formed decorations 51 on its upper side is fed by means of rollers 76, 78, 80, 18, 20 to a tank 12 filled with a liquid such as water. The pre-formed decorations 51 are separated from one another on the supporting film 50 and restrained relative to one another only by the supporting film 50. The chemical and physical structure of the film is not the subject of this invention, nor is the chemical and physical structure of the decoration applied to the film. Such decorations and supporting film are well known by those skilled in the art.

The housing 10 and the water tank 12 stand on a common foundation 14 which isolates and supports the entire transfer printing installation in such a way that outside mechanical disturbing influences are greatly diminished.

Film 50 with the decoration 51 is brought from the housing 10 to the surface of the water in the tank 12 by means of a film feed 16 in the form of an obliquely running conveyor belt. The conveyor belt of the film feed 16 runs over rollers 18, 20.

Figure 2:
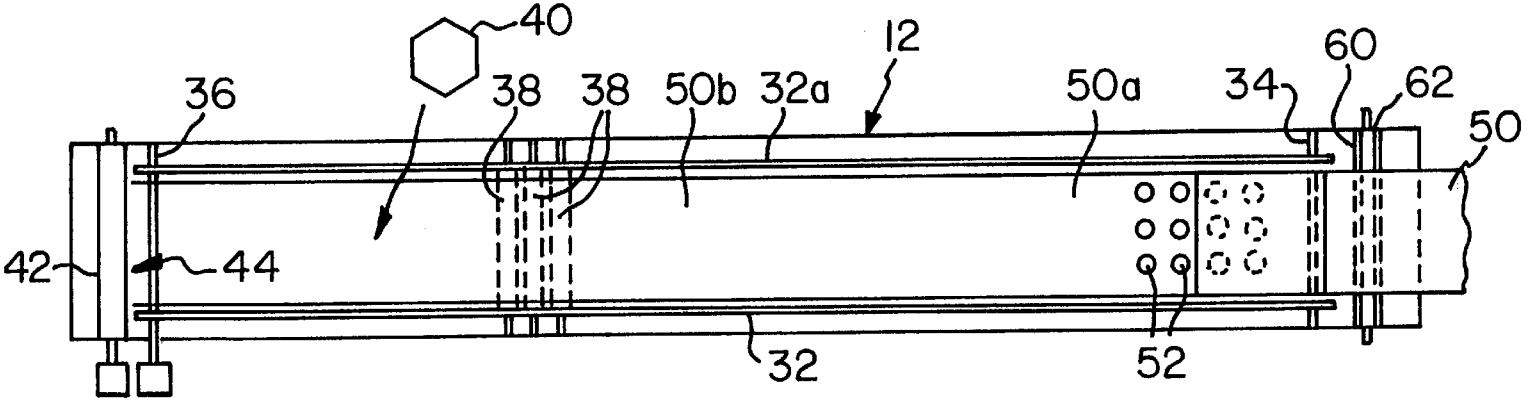
FIG. 2 shows a schematic of a plan view of the apparatus according to FIG. 1.
Figure 3:
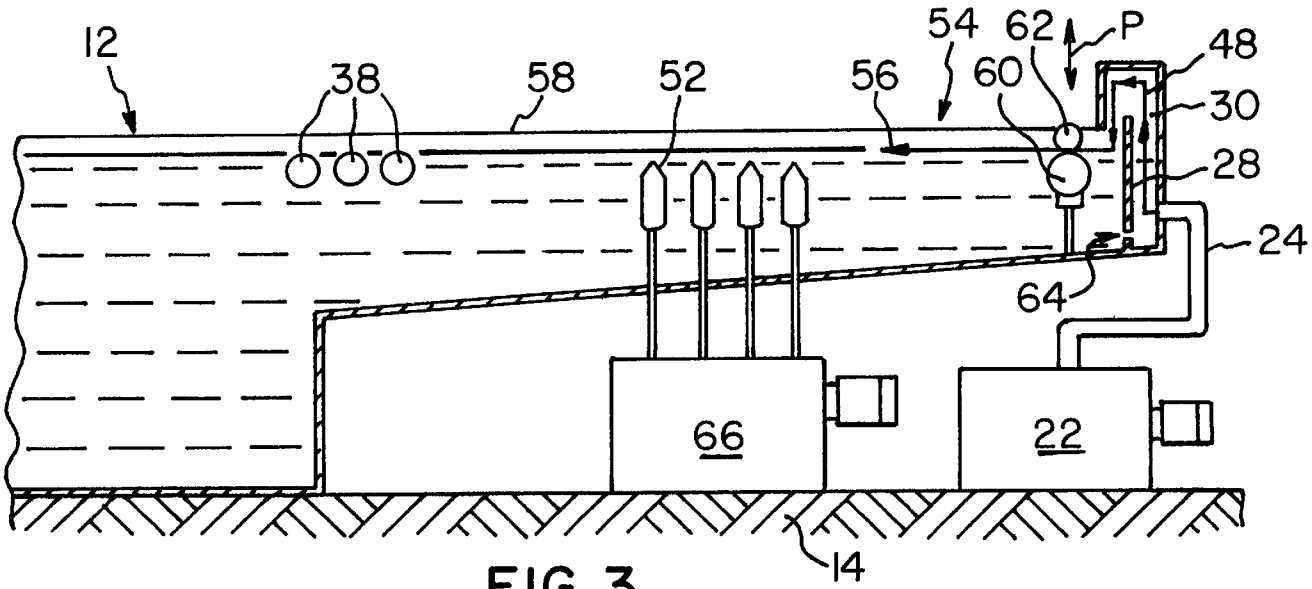
FIG. 3 shows a schematic of a side view of an upstream section of the apparatus according to FIG. 1.

In FIG. 1, and in each of the FIGS. 1 through 3, the water flows from right to left through the tank 12. For this purpose, a pump 22 is provided which maintains water circulation. A supply line 24 leads from the pump 22 into a cavity 30. The cavity 30 is filled and water is pumped over a dam wall 28 at a height which lies above the surface of the water in the tank 12 to a water inflow 26. The flow path of the water is shown in more detail by arrow 48 in FIG. 3 and the introduction of the water into the tank 12 is described more precisely further below.

The film 50 and the decoration 51 are presented to the tank 12 by the film feed 16 which is advanced in the direction of the water flow. Guide belts **32, 32*a* are laterally spaced and run over rollers 34, 36, which extend across the width of the tank 12**.

The process of transferring the decoration to an article is well known by those skilled in the art and is discussed in the prior art patents previously identified. An article 40 may be supported and manipulated for urging it against the decoration by devices well known by those skilled in the art, such as, for example, the means for submerging an object disclosed in U.S. Pat. No. 4,010,057. The article 40, which will receive the decoration 51, is immersed from above into the water in the tank 12 at a location marked by an arrow 41. At the same time, the film with the decoration is floating on the surface of the water, approximately at the height of the lateral guide belts **32, 32*a*. The article 40 is immersed over the decoration 51 such that the hydrostatic pressure on the floating decoration 51 urges the decoration 51 against the article 40**.

Figure 6:
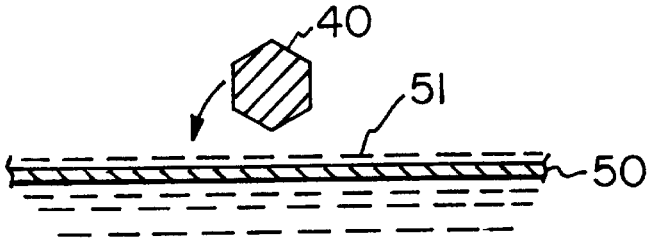
FIG. 6 shows a schematic view of an article to be decorated prior to the transfer of the decoration.

FIG. 6 diagrammatically shows the immersion of the article 40 into the liquid of which the supporting film 50 and the decoration 51 are floating. During this immersion hydrostatic pressure upon the decoration 51 urges the decoration 51 to conform to the three-dimensional shape of the article 40 and to adhere to the article 40. By this technique it is possible to print true to scale onto complicated three-dimensional articles.

During the immersion, the film 50 may largely, if not completely, dissolve in the water before the article 40 is pressed against the decoration 51. Therefore, after the decoration 51 is transferred to the article 40, there may remain in the flowing water residues of the film and of the decoration, which cannot be further used.

The roller 36 has, in addition to supporting the guide belts **32, 32*a*, an additional function in conjunction with roller 42, which is located downstream of roller 36 and extends across the entire width of the tank 12. These rollers are arranged such that a narrow gap 44 is left free between them. Film residues and decoration residues transported over the roller 36 reach the roller 42 and are transported further by the rotation of roller 42. These residues reach a filter 46 which separates the film residues and decoration residues from the water and discharges clean water into the lower region of the tank 12 and back to the pump 22. Also, through the narrow gap 44 between the rollers 36 and 42, relatively clean water returns into lower regions of the tank 12**.

FIGS. 2 and 3 show schematic drawings of the apparatus from above and from the side. FIG. 3 illustrates details of the introduction of water into the tank. As already stated above with reference to FIG. 1, the water rises in the cavity 30 over the dam wall 28 and falls from there into the tank 12. Provided underneath the dam wall 28 is an opening 64 (FIG. 3) through which excess water can enter directly into the tank 12.

In FIG. 3, the path of the water over the dam wall 28 is diagrammatically represented by arrow 48 and the associated solid line. The water is fed in through an intermediate space between two rotating rollers 60, 62 into the tank. The two rollers 60, 62 are arranged vertically one above the other and are adjustable vertically in the direction of an arrow P. While preferably both rollers 60, 62 have rotary drives, at least one roller, such as the lower roller, has a rotary drive. The rotational speed of the rollers is such that the water is transported in a direction corresponding to an arrow 56. The arrow 56 also marks the surface of the water in the tank 12.

In FIG. 3, the lower roller 60 thus rotates counterclockwise and the upper roller 62 rotates clockwise. By adjusting the rollers 60, 62 in their vertical height, adjusting their distance from each other and adjusting the rotational speed, the flow of the water into the tank can be optimally controlled. For example, the distance between the two rollers may be about 1 cm, depending on the requirements of the article to be printed. The distance is used to control the rate water is introduced to the upstream end of the tank 12. The rotational speed of the rollers (mainly of the lower roller 60) can be used to influence the flow velocity at the surface indicated by the arrow 56 in the tank 12. The rollers 60, 62 are preferably made with a smooth surface, for example, of stainless steel.

The level of the water in the tank 12 is continuously measured by means of a sensor (not shown). Any of a number of commercially available sensors are suitable. This information about water level is passed to a computer, which controls all the adjustable components and evaluates this information correspondingly. For example, if waves occur, the computer can alter the rotation, position and distance apart of the rollers 60, 62 in order to prevent the occurrence of waves and to keep the surface of the water calm.

It is possible to extend or condense the film 50 with the decoration 51 printed on it after the film 50 is introduced to the water of the tank 12. The film 50, with the decoration printed on it, is transported down from the film feed 16 and reaches the surface of the water in the tank 12 approximately at a point 54. There it floats on the surface and is carried along by the flow.

Figure 4B:
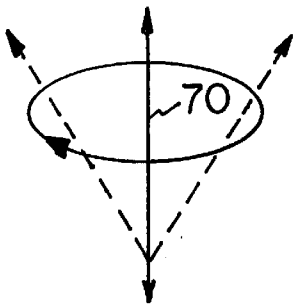
FIG. 4B shows a schematic view of the range of rotation available with each nozzle.
Figure 4A:
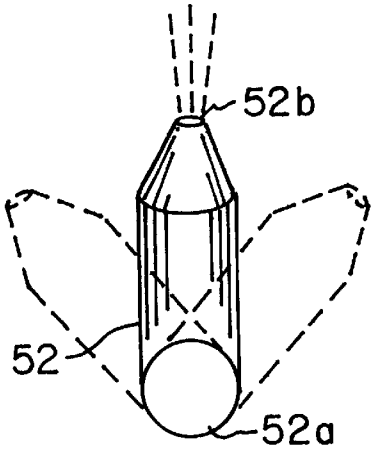
FIG. 4A shows a schematic view of a nozzle which may be adjusted to produce water flow in any one of a variety of directions.

Arranged below the surface of the water in the tank 12 is a plurality of nozzles 52 capable of directing the water to flow in various directions. FIG. 4A shows schematically in an enlarged representation a typical nozzle 52. Each nozzle may be spatially positioned, according to choice, for changing the flow directions, depending on the desired shaping of the film in a way corresponding to the article to receive the decoration.

According to the plan view of FIG. 2, an array of nozzles, for example an array of twelve nozzles in a 3×4 arrangement, is positioned in such a way that desired flows can be produced virtually at any desired point of the surface of the water as indicated by arrow 56. The nozzles 52 discharge a water flow upwards or obliquely upwards in order to extend or condense the stretchable and compressible film. In the region 50*a* (FIG. 2), the film 50 floating on the surface of the water as indicated by arrow 56 in the tank is thus extended or condensed in a way corresponding to the requirements of the article to be printed (not shown). FIG. 4B shows schematically the adjustability of the flow direction by means of a nozzle 52 pivotable about a base 52*a* and having a discharge orifice 52*b*. An axis 70 defines the flow direction of the nozzle 52, which is adjustable in an inclined manner with respect to the surface of the water as indicated by arrow 56.

In FIG. 1, a pump 66 used to drive the water through the nozzles 52 is represented. It should be understood that while a 3×4 array of nozzles has been disclosed, any number of nozzle patterns may be suitable to extend or condense the film 50 and the associated decoration 51, and the invention should not be limited to one specific arrangement.

In the region 50*b*, the film 50 with the decoration 51 has reached its desired (extended or condensed) shape and is transported downstream over a plurality of rollers 38. The rollers 38 are adjustable in their height in such a way that each of their upper edges is approximately flush with the surface of the water as indicated by arrow 56. The rollers 38 are preferably formed with a smooth surface, for example, of stainless steel. The rollers 38 preferably each have a rotary drive and may be adjusted for rotational speed and height. The rollers 38 can be used to calm the surface of the water, in particular downstream (to the left) and also to stabilize the advancement of the film. If need be (depending on the article receiving the decoration), the rollers 38 can also be used to adjust the advancing speed of the film to be faster or slower than the flow velocity of the water. The former is advisable in particular whenever the article to be printed has to be immersed very deeply into the tank or when the article has to be immersed quickly. Increasing the advancing speed of the film relative to the flow velocity of the water then prevents a tearing of the film.

In the case of the embodiment illustrated, three rollers 38 are provided which are cylindrical and independently adjustable with respect to one another for vertical position, rotational speed and horizontal distance. The rollers 38 can be used to control the feeding of the decorative film 50 as it progresses downstream.

Figure 5:
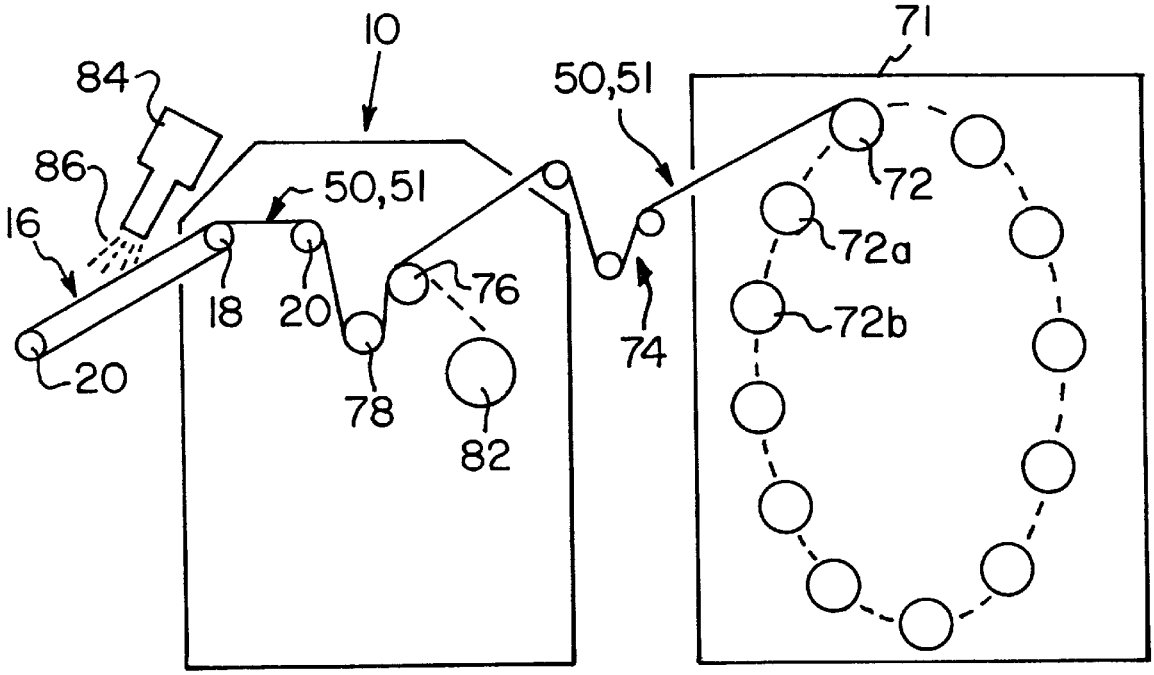
FIG. 5 shows a schematic view of a device for feeding additional film, coated with a decoration, to the water tank.

FIG. 5 shows a device for feeding additional film 50, covered with a decoration 51, to the tank 12. The housing 10 and the film feed 16 have already been described with reference to FIG. 1. Positioned before the housing 10 in the conveying direction of the film 50 is a further housing 71 containing, in the case of the exemplary embodiment represented, twelve rolls of film 72, 72*a*, 72*b* etc. For this purpose, in the housing 71 the physical and chemical conditions, such as the temperature, gas composition and humidity, are controlled in a manner known to those skilled in the art.

Via deflection rollers 74, the film 50 coated with the decoration 51 is transferred from a roll 72 in the housing 71 into the housing 10 and passes from there via deflection rollers 76, 78, 80 to the film feed 16. The feeding of the film is fully automated. In the case of the embodiment represented according to FIG. 5, the film 50 with the decoration 51 is drawn off directly from a roll of film 72 in the housing 71. The roll of film 72 has been printed in advance with the decoration 51 in a way known by one skilled in the art.

FIG. 5 also shows a roll of film 82 in the housing 10 from which the film 50 with the decoration 51 can alternatively be drawn off directly onto the roller 76, as is indicated by a dashed line.

In the past, the film and decoration have not been heated prior to their introduction into the water in the tank 12. However, it is possible to pre-treat the decoration 51 to enhance the transfer of the decoration onto the article 40 by heating the decoration 51 prior to introducing the film 50 and decoration 51 into the water of the tank 12. This may be done by spraying the decoration with a hot vapor such as hot water vapor. The hot vapor 86 may be produced by any number of different devices, schematically shown as 84 in FIG. 5. In one embodiment of the invention, the hot vapor spraying device 84 is positioned above the film feed 16, as shown in FIG. 5, and the water vapor is sprayed directly against the decoration 51 while the decoration 51 and film 50 are being conveyed along the film feed 16 to the tank 12.

The decoration 51 may be heated at any point prior to transferring the decoration 51 onto the article 40. In instances where the final temperature of the heated decoration is greater than the temperature of the water in the tank 12, it is possible to heat the decoration 51 after it has been introduced to the water in the tank 12 by means of hot water vapor and/or radiation.

The decoration 51 should be heated with a vapor spray having a temperature in the range of 30° C. (86° F.) to 90° C. (194° F.) and preferably to a temperature in the range of 40° C. (104° F.) to 70° C. (158° F.). The decoration should be subjected to this spray for a period of between 5 and 20 seconds. However, the spray temperature and time of exposure to the spray depend upon the individual decoration and film being used. The temperature and exposure time are optimized by experimentation (trial and error).

It is also possible to heat the decoration 51 by other means, such as through the use of radiation, such as infrared radiation in a fashion similar to that of the hot vapor. Furthermore, it is possible to use multiple means to heat the decoration 51, such as using both hot water vapor and radiation. The heating of the decoration may also take place directly by heating the water.

While the discussion has been directed to a supporting film 50 with a pre-formed decoration 51 upon it, it is possible, if the decoration 51 has enough stability and strength, for the decoration 51 to be processed and transferred to an article without the need for the supporting film 50. However, in this case there would be a continuous strip of pre-formed decorations that must be separated to accommodate each article.

Figure 7:
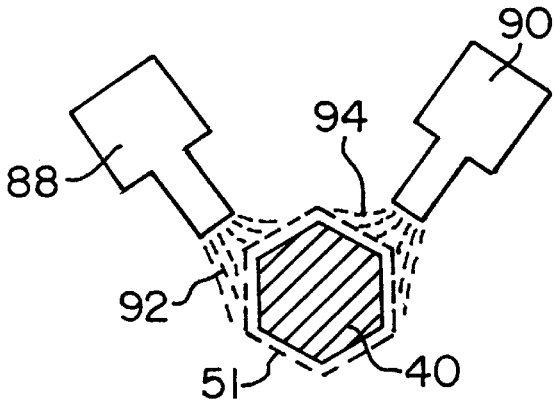
FIG. 7 shows a schematic view of a finished decorated article being treated with hot vapor.

The use of hot water vapor is useful not only prior to transferring the decoration 51 to the article 40 but is also useful in removing undesired residues from the decoration 51 after the transfer. FIG. 7 schematically shows the article 40, with decoration Si adhering thereto, after the transfer described. To remove undesired residues of the decoration 51 applied, two devices 88, 90 for producing hot water vapor 92, 94 are provided. The hot water vapor 92, 94 is directed at the surface of the article 40 to promote the removal of film residues or other undesired constituents.

Although the present invention has been described with respect to a specific embodiment, numerous modifications are possible without departing from the invention, and it is desirable to cover all modifications falling within the spirit and scope of this invention as set forth in the accompanying claims.

What is claimed is:

1. A method for applying a pre-formed decoration to an article utilizing the hydrostatic pressure of a liquid medium comprising the steps of:

a) heating the decoration to a temperature above ambient conditions by spraying the decoration with a vapor which consists of heated water vapor;

b) floating the heated decoration on the surface of a liquid;

c) positioning the article above the floating decoration; and d) immersing the positioned article into the liquid and against the floating decoration thereby permitting the decoration to transfer to the article.

2. The method according to claim 1 further comprising the step of supporting the decoration with a supporting film prior to transferring the decoration.

3. The method according to claim 1 wherein the water vapor is heated to a temperature of between 86 and 194 degrees Fahrenheit.

4. The method according to claim 1 wherein the water vapor is heated to a temperature of between 104 and 158 degrees Fahrenheit.

5. The method according to claim 1 wherein the the step of heating the decoration is further comprised of radiation heat upon the decoration.

6. The method according to claim 1 further including the step of spraying the decoration with a water vapor after the decoration is transferred to the article.

* * * * *

UNITED STATES PATENT AND TRADEMARK OFFICE

CERTIFICATE OF CORRECTION

PATENT NO. : 6,001,206

DATED : December 14, 1999

INVENTOR(S) : Maximilian Zaher

It is certified that error appears in the above-identified patent and that said Letters Patent is hereby corrected as shown below:

Column 6 Line 62 "with decoration Si" should read --with decoration 51--.

Column 8 Line 12, Claim 5, "wherein the the" should read --wherein the-- (delete duplicate text)

Column 8 Line 13, Claim 5, "radiation" should read --radiating--.

Signed and Sealed this

Eighth Day of August, 2000

*Attest:*

*Attesting Officer*

Q. TODD DICKINSON

*Director of Patents and Trademarks*